US006394059B2

(12) United States Patent
Guzman

(10) Patent No.: US 6,394,059 B2
(45) Date of Patent: May 28, 2002

(54) FRONT MODULE HOUSING

(75) Inventor: Saul A. Guzman, Chicago, IL (US)

(73) Assignee: International Engine Intellectual Property Company, L.L.C., Warrenville, IL (US)

( * ) Notice: Subject to any disclaimer, the term of this patent is extended or adjusted under 35 U.S.C. 154(b) by 0 days.

(21) Appl. No.: 09/767,557

(22) Filed: Jan. 22, 2001

Related U.S. Application Data

(60) Provisional application No. 60/178,160, filed on Jan. 26, 2000.

(51) Int. Cl.[7] ..... F01P 5/02; F01P 11/00
(52) U.S. Cl. ..... 123/195 R; 123/41.44
(58) Field of Search ..... 123/195 R, 41.14, 123/41.44

(56) References Cited

U.S. PATENT DOCUMENTS 3,001,517 A * 9/1961 Baker et al. ..... 123/195 R
3,263,663 A * 8/1966 Connell ..... 123/195 R
4,399,777 A * 8/1983 Hoettels ..... 123/195 R
5,083,545 A * 1/1992 Yamashita et al. ..... 123/195 R
5,718,196 A * 2/1998 Uchiyama et al. ..... 123/41.44
5,927,953 A * 7/1999 Marietti ..... 123/41.44
6,070,563 A * 6/2000 Achenbach et al. .... 123/195 R
6,112,706 A * 9/2000 Heer ..... 123/41.44

* cited by examiner

*Primary Examiner*—Paul J. Hirsch
(74) *Attorney, Agent, or Firm*—Dennis Kelly Sullivan; Jeffrey P. Calfa; Neil T. Powell

(57) ABSTRACT

There is provided an apparatus and method for a single piece integrated front module housing for an internal combustion engine, which decreases engine complexity, manufacturing time and production costs. The front module housing comprises a thermostat housing, a water pump housing, at least one coolant passage, an oil pump housing, and at least one oil passage. The front module housing further comprises a power steering pump mounting, an oil pressure regulating valve housing, at least one support boss member, an at least one sensor housing. There is provided a method for an integrated one-piece front module housing, comprising the steps of forming a front module housing casting mold and cores, forming the front module housing via introduction of molten material into the mold, removing the front module housing from the mold and removing the casting core from the cast front module housing, and finishing the front module housing.

22 Claims, 4 Drawing Sheets

FRONT MODULE HOUSING

This patent application claims the benefit of Provisional U.S. Pat. application Ser. No. 60/178,160 filed on Jan. 26, 2000.

FIELD OF THE INVENTION

This invention relates generally to front covers for internal combustion engines. More particularly, this invention relates to front covers integrating passages and mounting surfaces into a single integral module for an internal combustion engine.

BACKGROUND OF THE INVENTION

Internal combustion engines have front covers to enclose the crankcase and further have various engine components that are operatively attached to the front cover and front engine area. Typically, components such as a water pump, the front cover, oil pump, pump cover, thermostat housing, accessory component mounting brackets, various bolt-on hose attachments pieces, etc., all come separate and are installed as separate components. The installation of the various components is time consuming which can lead to increased manufacturing time and costs.

There is thus a need for a one piece multi-function assembly that would take the place of the various existing engine components and that integrates such components as coolant passages, oil passages, mounting surfaces, oil and water pump housings, thermostat housing, idler support bosses, sensor housing, etc.

SUMMARY OF THE INVENTION

The present invention provides an apparatus and method for a single piece integrated front module housing for an internal combustion engine. The front module housing decreases engine complexity, manufacturing time and production costs. Further, such an assembly could be supplied to an engine manufacturer as a fully assembled and tested component thereby optimizing engine manufacture. The front module includes various integrated components, e.g., supports structures, pump housings, oil and coolant passages, thermostat housing, and sensor housings among others.

The front module housing comprises a thermostat housing, a water pump housing, at least one coolant passage, an oil pump housing, and at least one oil passage. The front module housing can further comprise a power steering pump mounting, an oil pressure regulating valve housing, at least one support boss member, and at least one sensor housing.

There is also provided a method for a front module housing for use in an internal combustion engine. The method comprises the steps of forming a front module housing casting mold and casting core, forming the front module housing via introduction of molten material into a casting mold and core combination, removing the front module housing from the casting mold and further removing the casting core from the front module housing, and finishing the front module housing to desired specifications. The method preferably casts the front module housing is as single integral component.

The following drawings and description set forth additional advantages and benefits of the invention. More advantages and benefits will be obvious from the description and may be learned by practice of the invention.

BRIEF DESCRIPTION OF THE DRAWINGS

The present invention may be better understood when read in connection with the accompanying drawings, of which.

DETAILED DESCRIPTION OF THE INVENTION

Figure 1:
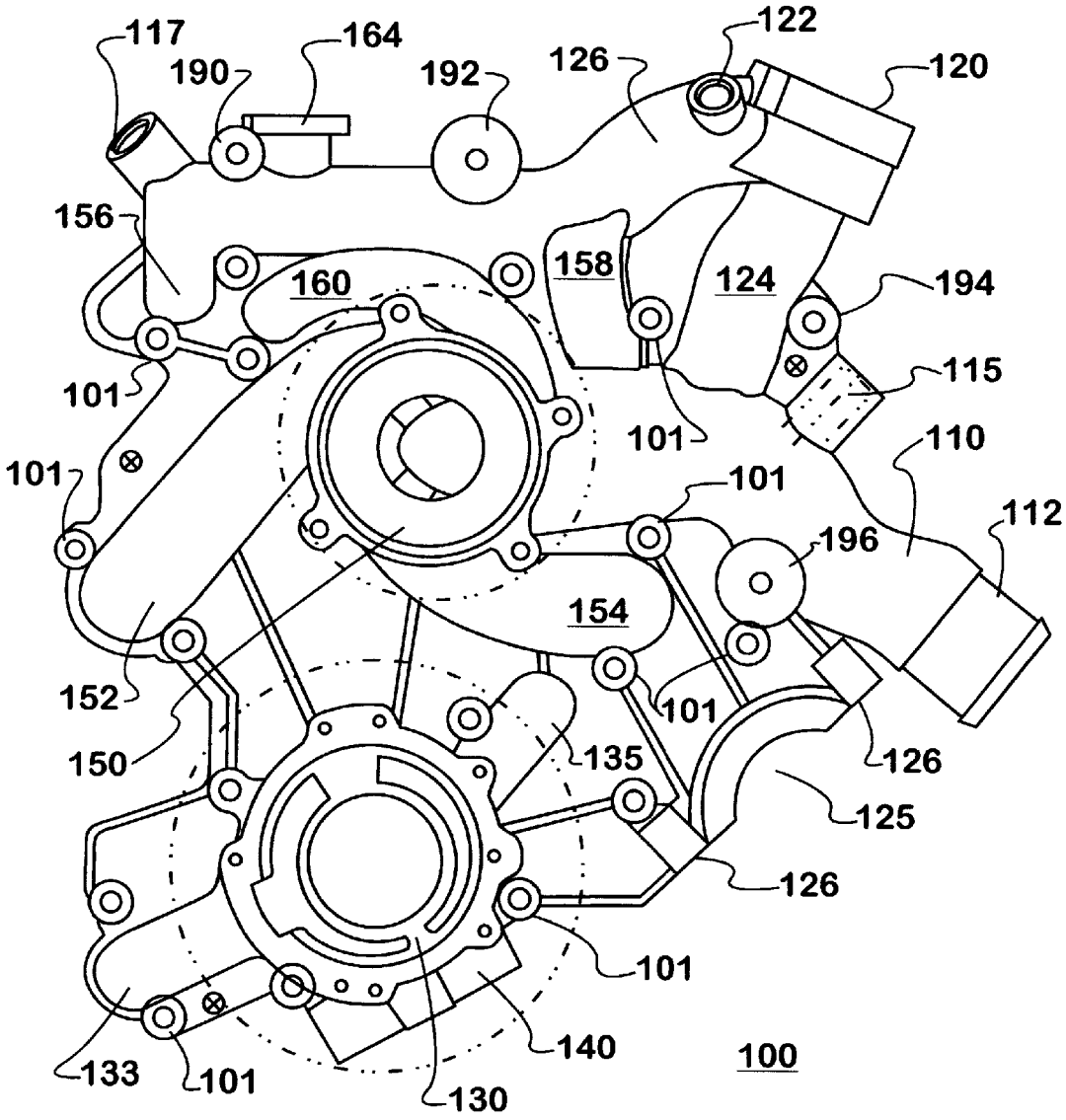
FIG. 1 shows a front view of an embodiment of the front module housing according to the present invention.

FIG. 1 illustrates a front view of an embodiment of the front module housing 100 according to the present invention. In a preferred embodiment, the front module housing 100 is cast (discussed in FIG. 4) as a single integrated component and then machined to meet specific application requirements. A plurality of front module housing mounting holes 101 (only certain mounting holes labeled for clarity) are preferably machined after the piece has been cast. The mounting holes 101 allow the front module housing 100 to be attached to the crankcase (not shown) by fastening bolts, e.g., M-8 type bolts.

Generally, the front module housing 100 comprises a water pump housing 150 in a midsection of the front module housing 100, a thermostat housing 120 on an the upper section of the front module housing 100, an oil pump/gerotor pump housing 130, various associated coolant and oil passages. The front module housing 100 can also include a power steering pump mounting 125, an oil pressure regulator (OPR) valve 140, and support boss members 190, 192, 194, an 196. Preferably associated with the water pump housing 150 are coolant passages 110, 124, 152, 154, 156, 158 and 160. Associated with the thermostat housing 120 are coolant passages 124, 126, 156, 158, and 164. Also, associated with the oil pump housing 130 are oil passages 133 and 135, and the OPR valve housing 140.

In operation, the water pump housing 150, through a water pump 350 (shown in FIG. 3), receives coolant via a hose line section 110. The water pump housing can also receive coolant via a thermostat bypass passage 124 and a heater core return passage 115. From the water pump housing 150 coolant is pumped into the crankcase via two lower coolant passages 152 and 154. Coolant is also pumped, via the water pump 350 (shown in FIG. 3) into an oil cooler and EGR circuit (not shown) via an upper central coolant passage 160.

"Hot" coolant is returned from the crankcase or engine to the front module housing 100 via two upper coolant passages 156 and 158, and a oil cooler/EGR circuit return coolant passage 164. The "hot" coolant now proceeds to the thermostat housing 120 via a thermostat return passage 126. Under appropriate circumstance, "hot" coolant from the thermostat return passage 126 flows to a heater core (not shown) via heater core feed passage 117, prior to reaching the thermostat section 120. The temperature of the hot coolant can be measured by a temperature sensor 223 (shown in FIG. 2) in a sensor housing 122. Depending on the temperature of the "hot" coolant, a thermostat (not shown) in a feedback circuit will determine whether the "hot" coolant can be recirculated back to the water pump housing 150, via a bypass passage 124, or whether the "hot" coolant will be passed to the radiator (not shown) for cooling.

The front module housing 100 also comprises an oil pump housing 130, oil passages 133 and 135, and an oil pressure regulating (OPR) valve housing 140. The front lube oil passage 133 serves to bring lube oil from the oil pan (not shown) to the oil pump or gerotor housing 130, via an oil pump (not shown). The oil pump will pressurized and pass the oil on to an oil discharge passage 135 and then onto the crankshaft and the rest of engine where appropriate. The regulating valve housing 140 will house an oil pressure regulating valve (not shown) that will operate to address excess oil pressure conditions. In a preferred embodiment, the oil pressure regulating valve housing 140 is cast and then machined as necessary.

In a preferred embodiment, the front module housing 100 further comprises a power steering pump mounting 125 and support boss members 190, 192, 194, and 196. The power steering pump mounting 125 will preferably be configured to accept a power steering pump (not shown), and will have two attachment portions 126 where the power steering pump will be attached to the front module housing 100. The front module housing 100 also has four support boss members 190, 192, 194, and 196. The support boss members 190, 192, 194, and 196 will preferably be used to mount idler pulleys for belt drives. Other component and equipment may instead be mounted on the support boss members 190, 192, 194, and 196. Also, more or less than the four support bosses 190, 192, 194, and 196 shown may be used on a front module housing 100 depending on a particular engine application.

Figure 2:
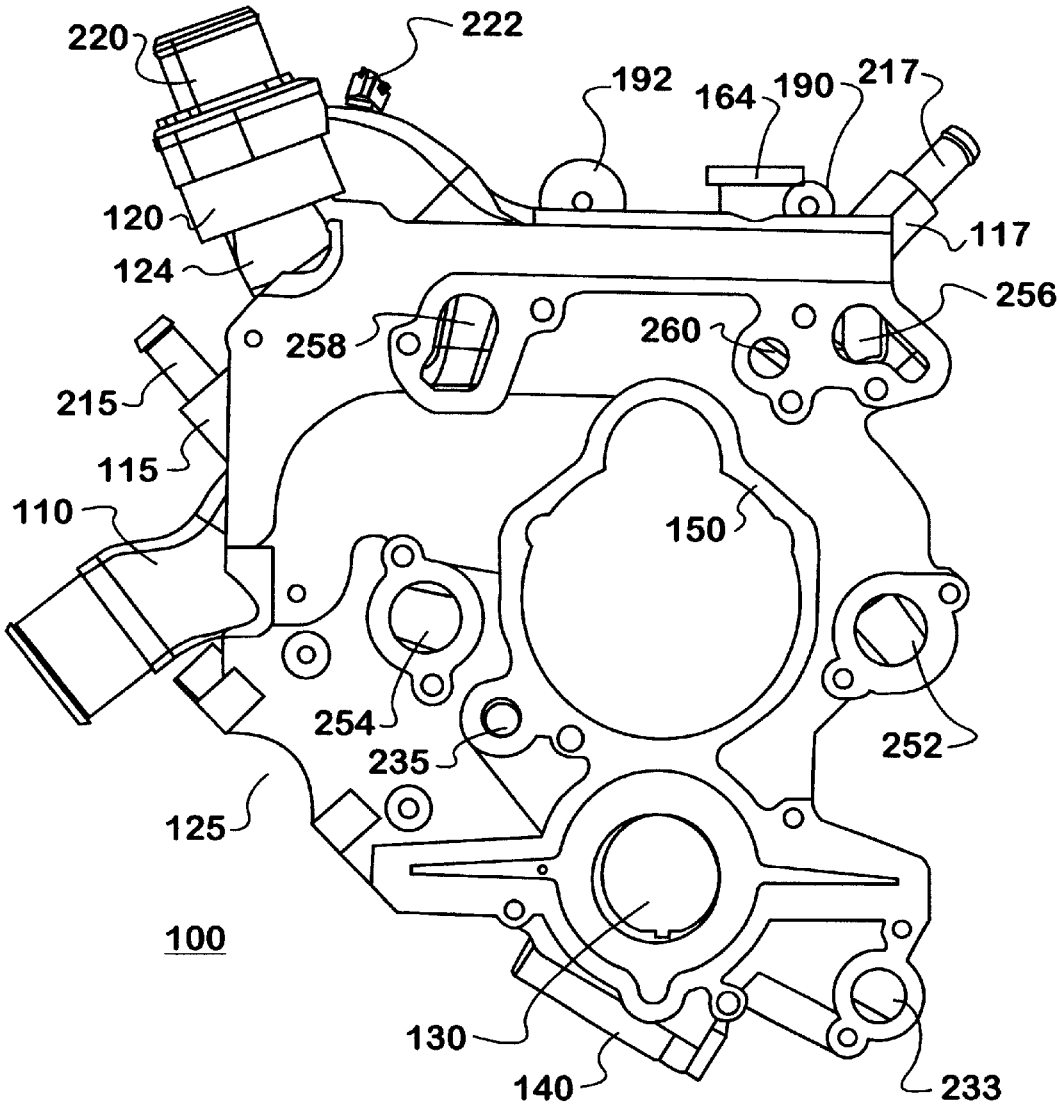
FIG. 2 shows a rear view of an embodiment of the front module housing according to the present invention.

FIG. 2 shows a rear view of the embodiment of the front module housing shown in FIG. 1 with some attached components. As in FIG. 1, there is shown the water pump housing 150, hose line section 110, the oil pump housing 130, OPR valve housing 140, the power steering pump mounting 125 and the support boss members 190, 192, 194, and 196.

FIG. 2 further shows the rear coolant apertures 252, 254, 256, 258, and 260 of the respective coolant passages 152, 154, 156, 158 and 160 of the front module housing 100. Coolant will be pumped into the crankcase via the two lower rear coolant apertures 252 and 254, and to an oil cooler and EGR circuit (not shown) via the upper central rear coolant aperture 260. "Hot" coolant is returned from the crankcase to the front module housing 100 via the two upper rear coolant apertures 256 and 258, and the oil cooler/EGR circuit return coolant passage 164. The coolant will then flow as described in FIG. 1. Also shown are the rear oil apertures 233 and 235 of the respective oil passages 133 and 135 of the front module housing 100. The front lube oil passage 133 serves to bring lube oil from the oil pan (not shown) through the rear intake aperture 233 and into the oil pump or gerotor housing 130. The oil is then passed on to an oil discharge passage 135 through the rear discharge aperture 235 and then into the crankshaft.

FIG. 2 also shows a thermostat assembly 220 connected to the thermostat housing 120, which houses a thermostat (not shown). Also shown, is a coolant temperature sensor 222 in the sensor housing 122 of the front module housing 100. Of course, those of skill in the art will readily recognize that the sensor housing 122 could be located elsewhere on the front module housing 100, and that other sensors could instead be used in the housing, e.g., oil temperature sensors, pressure sensors, etc. Finally, FIG. 2 shows press fit tubes 215 and 217 operatively connected to the heater core return passage 115 and to the heater core feed passage 117 respectively. The press fit tubs 215 and 217 should simplify hose connections at these points on the front module housing 100.

Figure 3:
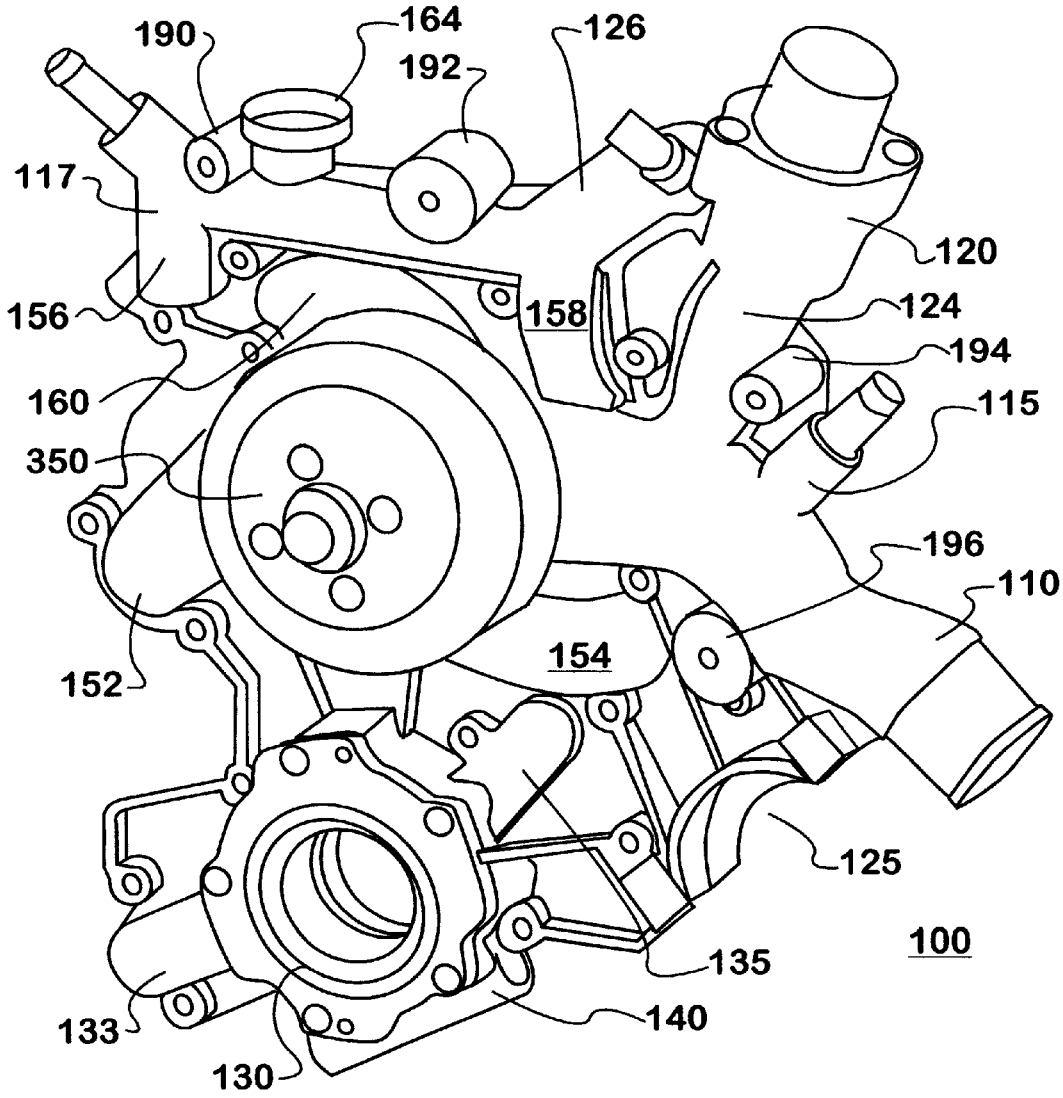
FIG. 3 shows an isometric front view of an embodiment of the front module housing according to the present invention.

FIG. 3 shows an isometric front view the embodiment of the front module housing shown in FIG. 2 with some attached components. FIG. 3 additionally shows a water pump 350 mounted in the water pump housing 150 of the front module housing. Also shown is a gerotor cover 330 mounted to the oil pump housing 130. The gerotor cover 33 can be a die-cast component and will keep the gerotor gears in place.

Figure 4:
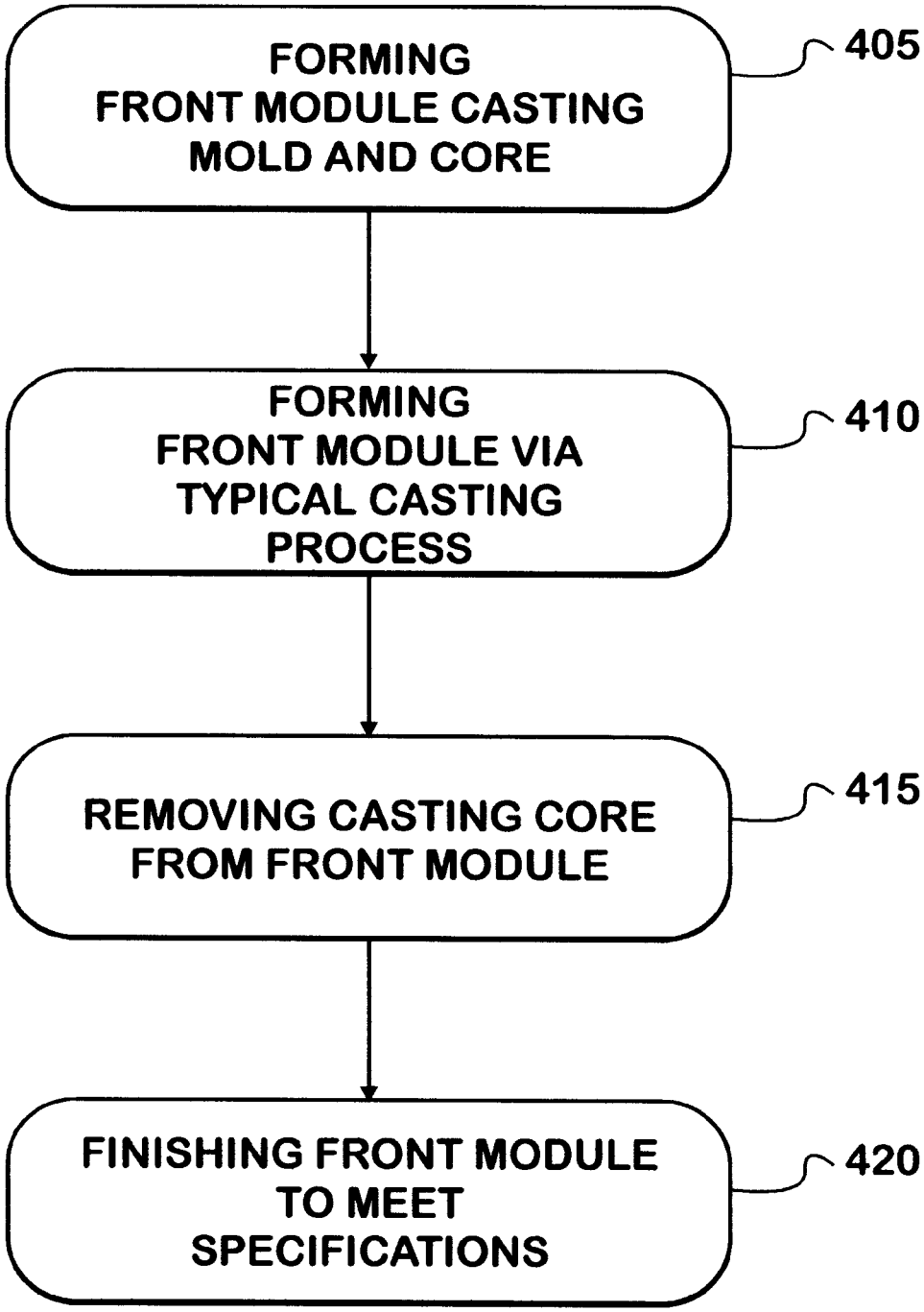
FIG. 4 shows a method for the front module housing according to the present invention.

FIG. 4 shows a method for forming the front module housing 100 of the present invention. In a first step 405, a casting mold and casting cores (not shown) are formed to be used in casting the desired front module housing 100. Those of skill in the art will recognize that the final configuration of the front module housing 100 will be dependent on the type of engine on which the front module housing 100 is to be used on. The casting mold and core are formed using typical and well know core casting techniques. The center core will, in the molding process, form voids or hollowed out sections in the front module housing 100 that will result in the configuration of the front module housing 100 (as shown and discussed in FIGS. 1–3).

In a second step 410, the front module housing 100 is formed by pouring molten material into casting mold and core combination. The molten material is preferably aluminum which exhibits good weight and strength characteristics and will give the. Those of skill will readily recognize that the front module housing 100 could also be made of other materials, e.g., grade cast iron, steel or gray steel, depending on the specific engine application involved.

In step 415, after appropriate cooling time the front module housing 100 is removed from the casting mold and the casting cores are removed. In step 420, the front module housing 100 is finish appropriately to meet the specifications of a particular engine application.

The invention has been described and illustrated with respect to certain preferred embodiments by way of example only. Those skilled in that art will recognize that the preferred embodiments may be altered or amended without departing from the true spirit and scope of the invention. Therefore, the invention is not limited to the specific details, representative devices, and illustrated examples in this description. The present invention is limited only by the following claims and equivalents.

I claim:

1. A front module housing for an internal combustion engine comprising:

a thermostat housing;

a water pump housing;

at least one coolant passage;

an oil pump housing; and at least one oil passage.

2. The front module housing of claim 1, further comprising a power steering pump mounting.

3. The front module housing of claim 2, further comprising an oil pressure regulating valve housing.

4. The front module housing of claim 3, further comprising at least one support boss member.

5. The front module housing of claim 4, further comprising at least one sensor housing.

6. The front module housing of claim 5, wherein the sensor housing is a coolant temperature sensor housing or an oil temperature sensor housing.

7. The front module housing of claim 1, wherein the front module housing is a single integral piece.

8. The front module housing of claim 1, wherein the front module housing is cast using a casting core.

9. The front module housing of claim 1, wherein the front module housing is cast aluminum.

10. A front module housing for an internal combustion engine comprising:

a thermostat housing;

a water pump housing;

at least one coolant passage;

an oil pump housing;

at least one oil passage;

an oil pressure regulating valve housing; and a power steering pump mounting.

11. The front module housing of claim 10, further comprises: at least one support boss member; and at least one sensor housing.

12. The front module housing of claim 11, wherein the sensor housing is a coolant temperature sensor housing or an oil temperature sensor housing.

13. The front module housing of claim 12, wherein the front module assembly is an integral cast piece, and is cast using a casting core.

14. A front module housing for an internal combustion engine comprising:

a thermostat housing;

a coolant temperature sensor housing;

a water pump housing;

at least one coolant passage;

an oil pump housing;

at least one oil passage;

an oil pressure regulating valve housing;

a power steering pump mounting; and at least one support boss member.

15. A method for a front module housing for use in an internal combustion engine, the method comprising the steps of:

forming a front module housing casting mold and casting core;

forming the front module housing via introduction of molten material into a casting mold and core combination;

removing the front module housing from the casting mold and further removing the casting core from the front module housing; and finishing the front module housing to desired specifications. wherein the front module housing comprises:

a thermostat housing;

a water pump housing;

at least one coolant passage;

an oil pump housing; and at least one oil passage.

16. The method of claim 15, wherein the front module housing further comprises a power steering pump mounting.

17. The method of claim 16, wherein front module housing further comprises an oil pressure regulating valve housing.

18. The method of claim 17, wherein front module housing further comprises at least one support boss member.

19. The method of claim 18, wherein front module housing further comprises at least one sensor housing.

20. The method of claim 15, wherein the sensor housing is a coolant temperature sensor housing or an oil temperature sensor housing.

21. The method of claim 16, wherein the front module housing is cast as a single integral piece.

22. The method of claim 16, wherein the molten material is cast aluminum or steel.

* * * * *